US005225041A

United States Patent [19]

Richard et al.

[11] Patent Number: 5,225,041

[45] Date of Patent: Jul. 6, 1993

[54] REFINING PROCESS FOR PAPER PULP USING A SILICA SOL

[75] Inventors: Michel Richard, L'Isle Adam; Christian Roux, Mery; Claude Trouve, Yerres, all of France

[73] Assignee: Societe Francaise Hoechst, Puteaux, France

[21] Appl. No.: 828,760

[22] Filed: Jan. 31, 1992

[30] Foreign Application Priority Data

Jan. 31, 1991 [FR] France ..... 91 01108

[51] Int. Cl.[5] ..... D21D 1/20

[52] U.S. Cl. ..... 162/80; 162/26; 162/181.6

[58] Field of Search ..... 162/26, 80, 181.6, 187, 162/9

[56] References Cited

U.S. PATENT DOCUMENTS

| | | | |
|---|---|---|---|
| 4,311,553 | 1/1982 | Akerlund et al. | 162/80 |
| 4,643,801 | 2/1987 | Johnson | 162/175 |
| 4,755,259 | 7/1988 | Larsson | 162/181.6 |
| 4,795,531 | 1/1987 | Sofia et al. | 162/181.6 |
| 4,849,053 | 7/1989 | Gentile, Jr. et al. | 162/80 |

*Primary Examiner*—Karen M. Hastings

*Attorney, Agent, or Firm*—Browdy and Neimark

[57] ABSTRACT

A refining process for paper pulp in which colloidal silica sol is mixed with the paper pulp to be refined. The addition of the colloidal silica sol reduces the time necessary to refine the pulp to a predetermined freeness value compared to refining in the absence of the colloidal silica sol.

3 Claims, No Drawings

REFINING PROCESS FOR PAPER PULP USING A SILICA SOL

The present invention relates to a new refining process for paper pulp.

In the manufacture of paper pulp, refining is an essential operation which consumes larger amounts of energy the higher the desired freeness value is.

From time immemorial, paper manufacturers have sought ways of reducing the energy costs of refining paper pulp and notably they have thus envisaged carrying out refining in the presence of carboxymethylcellulose or even Congo red, useful solutions, which were, however, abandoned due to the abnormally high viscosities obtained and also to the coloration given to the pulps by using Congo red. So that today, the refining of paper pulps is in the great majority of cases carried out without using additives with a high level of energy consumption.

Now the Applicant has discovered with astonishment a new refining process for paper pulp which is clearly less expensive than the known processes.

The process according to the invention is characterized in that it is carried out in the presence of a colloidal silica sol.

By colloidal silica sol is meant aqueous suspensions of elementary particles of silica having an average diameter of less than 100 nm and non-agglomerated between and among themselves. These silica sols are commercially-available products such as those marketed by the Applicant under the name KLEBOSOL.

In the advantageous conditions for implementing the invention, the process described above is carried out in the presence of a colloidal silica sol the elementary particles of which have an average diameter comprised between 10 and 50 nm.

The process according to the invention will be preferably carried out in the presence of 1 to 50% by weight of colloidal silica expressed in the dry state relative to the weight of paper pulp also expressed in the dry state.

According to the process of the invention, the silica sol and the pulp to be refined are mixed together, for example by the incorporation of said silica in the paper pulp to be refined, then the refining is carried out in a standard manner in a conventional industrial refiner until the desired Shoepper-Riegler freeness value is obtained, usually of the order of 30 to 40. The paper pulp thus obtained is then used like paper pulps which have been conventionally refined.

The process according to the invention allows the duration of refining for paper pulps of various origins to be considerably reduced. Generally the time saving for obtaining a Shoepper-Riegler freeness value of the order of 35 is 30 to 35% relative to the process carried out in the absence of colloidal silica sol.

In this way, for example, starting with 360 g of a paper pulp containing by weight 30% eucalyptus, 45% birch and 25% conifers, containing therefore 25% long fibres, refined according to the AFNOR Q 50-008 standard using a pile valley, the obtaining of a Shoepper-Riegler freeness value of 45 requires about 34 minutes in the absence of silica sol and only 24 minutes in the presence of 545 g of a silica sol containing by weight 67% water and 33% silica in the form of non-agglomerated elementary particles with an average diameter of 13 nm. Therefore, for the obtaining of an identical freeness value starting with an identical pulp, the process according to the invention allows the refining time to be reduced by 10 minutes, i.e. a time saving of about 33%. In table 1, the Shoepper-Riegler freeness values obtained are noted as a function of time.

TABLE 1

| | Shoepper-Riegler freeness value as a function of time | |
|---|---|---|
| Time | In the presence of colloidal silica | In the absence of colloidal silica |
| 0 min | 15 | 16 |
| 5 min | 18 | 18 |
| 10 min | 21 | 19 |
| 15 min | 27 | 22 |
| 20 min | 35 | 25 |
| 25 min | 50 | 30 |
| 30 min | 62 | 35 |
| 35 min | 65 | 50 |
| 45 min | 80 | 70 |

We claim:

1. A process for refining paper pulp consisting essentially of adding to said paper pulp a colloidal silica sol in an amount effective to reduce the time necessary to refine said paper pulp to a predetermined freeness value compared to refining in the absence of said colloidal silica sol, said amount comprising 1–50% by weight of said silica sol, on a dry basis, relative to the weight of said paper pulp on a dry basis, and refining said paper pulp in the presence of said colloidal silica sol to said predetermined freeness value.

2. A process according to claim 1 wherein said silica sol consists essentially of silica particles having an average diameter between 10 nm and 50 nm.

3. A process according to claim 1 wherein said refining is carried out over a time on the order of 30–35% less than the time necessary to refine said paper pulp to said predetermined freeness in the absence of said colloidal silica sol.

* * * * *